US010147289B2

(12) United States Patent
Britton, Jr. et al.

(10) Patent No.: US 10,147,289 B2
(45) Date of Patent: Dec. 4, 2018

(54) MAGNETIC FIELD SENSING FOR TAMPER-INDICATING DEVICES

(71) Applicant: UT-Battelle, LLC, Oak Ridge, TN (US)

(72) Inventors: Charles L. Britton, Jr., Alcoa, TN (US); Steven S. Frank, Knoxville, TN (US); Michael J. Kuhn, Knoxville, TN (US); Andrzej Nycz, Knoxville, TN (US); Chris A. Pickett, Clinton, TN (US); Scott L. Stewart, Knoxville, TN (US); Robert J. Warmack, Knoxville, TN (US); Richard A. Willems, Knoxville, TN (US); James R. Younkin, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 15/946,397

(22) Filed: Apr. 5, 2018

(65) Prior Publication Data

US 2018/0293860 A1 Oct. 11, 2018

Related U.S. Application Data

(60) Provisional application No. 62/481,717, filed on Apr. 5, 2017.

(51) Int. Cl.
*G08B 13/14* (2006.01)
*G08B 13/24* (2006.01)
(Continued)

(52) U.S. Cl.
CPC ..... *G08B 13/24* (2013.01); *G08B 21/182* (2013.01); *G08B 29/185* (2013.01)

(58) Field of Classification Search
CPC .... G08B 13/24; G08B 21/182; G08B 29/185; G08B 13/1436; G08B 13/149;
(Continued)

(56) References Cited

U.S. PATENT DOCUMENTS 4,707,679 A 11/1987 Kennon et al.
5,910,774 A 6/1999 Capriotti et al.
(Continued)

OTHER PUBLICATIONS

Britton, C. et al., "Testing of the Authenticatable Container Tracking System (ACTS)", Proceedings of the 18th International Symposium on the Packaging and Transportation of Radioactive Materials PATRAM 2016, Sep. 18-23, 2016, pp. 1-11.
(Continued)

*Primary Examiner* — Anh V La
(74) *Attorney, Agent, or Firm* — Scully, Scott, Murphy & Presser, P.C.

(57) ABSTRACT

Sensing devices, systems and methods for securing articles against tampering using a unique magnetic field signature measured at two different times are provided. One or more sensing devices are secured to a ferrous surface portion of a target container. The sensing devices are secured using a plurality of magnets. The unique magnetic field signature sensed by a sensing device is produced by a combination of the plurality of magnets of the sensing device and the ferrous surface portion of the target container and earth's magnetic field. The two different times being one of a baseline measurement session and one of an observation measurement session. An observation measurement session may be triggered by a shock event or periodically.

19 Claims, 16 Drawing Sheets

(51) Int. Cl.
*G08B 21/18* (2006.01)
*G08B 29/18* (2006.01)

(58) Field of Classification Search
CPC .. G08B 13/00; G08B 13/1463; G08B 13/126; G08B 13/06; G06F 21/88; G06F 13/4068; H04W 12/12; G06Q 10/0833; G06Q 10/08; E05B 73/00; E05B 65/52; Y10T 70/40; Y10T 70/50; Y10T 70/5004; Y10T 70/5009
USPC ..... 340/540, 571, 669, 689, 568.1, 686.1
See application file for complete search history.

(56) References Cited

U.S. PATENT DOCUMENTS 6,784,796 B2 * 8/2004 Johnston ..... G08B 13/06 324/207.11
6,882,275 B2 4/2005 Blanpain et al.
7,053,823 B2 * 5/2006 Cervinka ..... G08B 25/08 340/568.1
8,294,577 B2 10/2012 Deak
8,436,731 B2 * 5/2013 Davis ..... G08B 13/1436 340/540
2013/0265163 A1 10/2013 Joyce
2015/0048947 A1 * 2/2015 Yang ..... G08B 13/248 340/572.8
2015/0102940 A1 4/2015 Keech et al.
2015/0262461 A1 * 9/2015 Richter ..... G08B 13/149 340/568.1
2015/0355238 A1 12/2015 Ramirez
2016/0084632 A1 3/2016 Zigovszki et al.

OTHER PUBLICATIONS

Britton, C. et al., "Enhanced Containment and Surveillance System: Active Container Tracking System (ACTS)", Presented at the 37th Annual ESARDA Meeting, May 18-21, 2015, pp. 1-4.
Anderson, J. et al., "Tracking and Monitoring with Dosimeter-Enabled ARG-US RFID System", WM2012 Conference, Feb. 26-Mar. 1, 2012, pp. 1-8.

* cited by examiner

1

1100

1200

MAGNETIC FIELD SENSING FOR TAMPER-INDICATING DEVICES

CROSS REFERENCE TO RELATED APPLICATION

The present application claims benefit of U.S. Application No. 62/481,717, filed on Apr. 5, 2017, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

FIELD OF THE DISCLOSURE

The present disclosure relates to securing articles and more specifically to sensing devices, systems and methods for securing articles against tampering.

BACKGROUND

The ability to sense attempts to remove, damage, or disable electronic monitoring and tracking devices is important in many applications. For example, electronic monitoring devices are used in tracking storage container in processing, storage and/or treaty venues. These storage containers may house chemicals such as uranium hexafluoride or other valuable assets. Motion sensors, acoustic sensors and light sensors used in monitoring and tracking devices, may be spoofed.

SUMMARY

Accordingly, disclosed is an authenticatable container tracking device. The tracking device comprises a non-metallic casing and a plurality of magnets mounted to the non-metallic casing. The mounting allows each of the plurality of magnets to conform to a ferrous surface portion of a target container. The mounting and the plurality of magnets are configured to securely attach the non-metallic casing to the ferrous surface portion of the target container. The non-metallic casing comprises a three-axis magnetometer, a shock sensor, a processor, a memory and a power supply. The three-axis magnetometer has a sleep mode and an active mode. In sleep mode, a first level of power is supplied to the three-axis magnetometer and in the active mode, a second level of power is supplied to the three-axis magnetometer. The three-axis magnetometer is configured to detect a magnetic field signature produced by a combination of the plurality of magnets and the ferrous surface portion of the target container and earth's magnetic field.

The processor is in electrical communication with the three-axis magnetometer and the shock sensor. The memory is configured to store an alarm threshold and a percentage of allowed values above the alarm threshold. The alarm threshold and the percentage are determined during a baseline measurement session. The power supply is configured to provide power to the processor, the shock sensor and the three-axis magnetometer.

The processor is configured to: receive a detection indication from the shock sensor, trigger the active mode for the three-axis magnetometer based on the detection indication by causing the second level of power to be supplied from the power supply and receive detections of the magnetic field signature from the three-axis magnetometer over a measurement period.

For each detection of the magnetic field signature, the processor is configured to: convert the detection to a value; and compare the value with the alarm threshold stored in the memory.

The processor is further configured to determine a percentage of detections having the value above the alarm threshold and compare the percentage of detections having the value above the alarm threshold with the percentage of allowed values above the alarm threshold stored in the memory. When the percentage of detections having the value above the alarm threshold is greater than the percentage of allowed values above the alarm threshold, the processor is configured to generate an alert.

Also disclosed is an authenticatable container tracking system. The system comprises a non-metallic casing and a plurality of magnets mounted to the non-metallic casing. The mounting allows each of the plurality of magnets to conform to a ferrous surface portion of a target container. The mounting and the plurality of magnets are configured to securely attach the non-metallic casing to the ferrous surface portion of the target container. The non-metallic casing comprises a three-axis magnetometer, a shock sensor, a transmitter, a processor, a memory and a power supply.

The three axis magnetometer has a sleep mode and an active mode. In sleep mode, a first level of power is supplied to the three-axis magnetometer, and in the active mode, a second level of power is supplied to the three-axis magnetometer. The three-axis magnetometer is configured to detect a magnetic field signature produced by a combination of the plurality of magnets and the ferrous surface portion of the target container and earth's magnetic field. The processor is in electrical communication with the three-axis magnetometer, the shock sensor and the transmitter.

The power supply is configured to provide power to the processor, the shock sensor, the three-axis magnetometer and the transmitter.

The processor is configured to receive a detection indication from the shock sensor, trigger the active mode for the three-axis magnetometer based on the detection indication by causing the second level of power to be supplied from the power supply, receive detections of the magnetic field signature from the three-axis magnetometer over a measurement period and cause the transmitter to transmit the received detections to an external processor.

The external processor is configured to, for each detection of the magnetic field signature, convert the detection to a value and compare the value with an alarm threshold.

The external processor is further configured to determine a percentage of detections having the value above the alarm threshold and compare the percentage of detections having the value above the alarm threshold with a preset percentage of allowed values above the alarm threshold. When the percentage of detections having the value above the alarm threshold is greater than the preset percentage of allowed values above the alarm threshold, the external processor is configured to generate an alert.

Also disclosed is an authenticatable container tracking device. The tracking device comprises a non-metallic casing and a plurality of magnets mounted to the non-metallic casing. The mounting allows each of the plurality of magnets to conform to a ferrous surface portion of a target container. The mounting and the plurality of magnets is configured to securely attach the non-metallic casing to the ferrous surface portion of the target container. The non-metallic casing comprises a three-axis magnetometer, a processor, a memory and a power supply.

The three-axis magnetometer has a sleep mode and an active mode. In sleep mode, a first level of power is supplied to the three-axis magnetometer, and in the active mode, a second level of power is supplied to the three-axis magnetometer. The three-axis magnetometer is configured to detect a magnetic field signature produced by a combination of the plurality of magnets and the ferrous surface portion of the target container and earth's magnetic field.

The processor is in electrical communication with the three-axis magnetometer. The memory configured to store alarm threshold and a percentage of allowed values above the alarm threshold. The alarm threshold and the percentage are determined during a baseline measurement session. The power supply is configured to provide power to the processor and the three-axis magnetometer, The processor is configured to periodically trigger the active mode for the three-axis magnetometer by causing the second level of power to be supplied from the power supply for a detection session, receive detections of the magnetic field signature from the three-axis magnetometer over a measurement period.

After receiving the detection results, the processor is configured to cause the first level of power to be supplied from the power supply to trigger the sleep mode.

For each detection of the magnetic field signature, the processor is configured to convert the detection to a value and compare the value with the alarm threshold stored in the memory.

The processor is further configured to determine a percentage of detections having the value above the alarm threshold and compare the percentage of detections having the value above the alarm threshold with the percentage of allowed values above the alarm threshold stored in the memory. When the percentage of detections having the value above the alarm threshold is greater than the percentage allowed values above the alarm threshold, the processor is configured to generate an alert.

BRIEF DESCRIPTION OF THE DRAWINGS

The devices, methods and/or systems may be better understood with reference to the following figures and description. Non-limiting and non-exhaustive descriptions are described with reference to the following figures. The components in the figures are not necessarily to scale, emphasis instead being placed upon the illustrating principles. In the figures, like reference numerals may refer to like parts throughout the different figures unless otherwise specified.

DETAILED DESCRIPTION

Authenticatable container tracking devices (ACTD), the systems and the methods described herein provide tamper protection for an article through detecting and analyzing magnetic field signatures from two different times: a baseline measurement session and a detection session (also referred to herein as an observation measurement session). The ACTD is mounted to a target article via magnets. Advantageously, the same magnets are used to provide a portion of the detected magnetic field signature. Since the ACTD is mounted using magnets, the ACTD may be used for any article having at least a portion of its surface being made of a ferrous material. For example, the target article may be a steel container holding chemicals such as, but not limited to uranium hexafluoride or other gases. Additionally, the target article may be a bank vault or a safe.

The ACTD, the systems and the methods can be used to optimize chain-of-custody monitoring for materials such as packaged nuclear materials as they are being stored, processed and transported.

Figure 1:
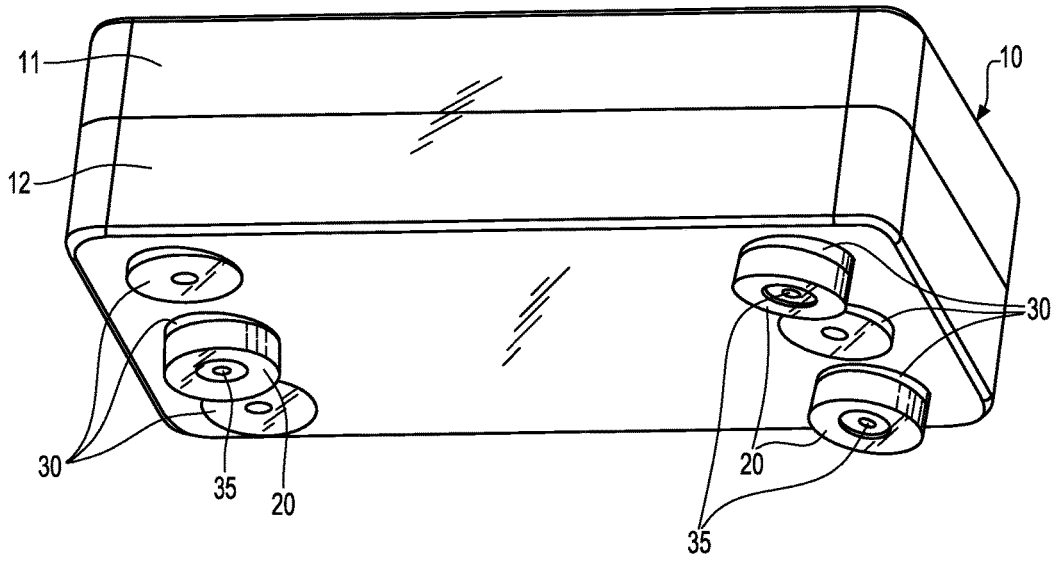
FIG. 1 depicts a perspective view of an authenticatable container tracking device in accordance with aspects of the disclosure.

FIG. 1 depicts a perspective view of ACTD 1 in accordance with aspects of the disclosure. The ACTD 1 comprises a casing 10. The casing 10 is non-metallic and may be made of ABS or PVC plastic for example. By using a non-metallic casing, distortion of the magnetic field signature may be avoided. Additionally, by using a non-metallic casing, a magnetic field is not produced by the casing 10 itself. In an aspect of the disclosure, the casing 10 may be manufactured using 3-D printing techniques. The casing 10 may comprise two portions such as a first portion 11 and a second portion 12. The casing 10 opens and closes to allow for internal components to be installed. When opened, the first portion 11 and the second portion 12 separate. The casing 10 may be locked when closed (not shown in FIG. 1). In an aspect of the disclosure, hinges may be used to facilitate opening and closing. Alternatively, the first portion 11 and the second portion 12 may completely separate when opened. The casing 10 may be opaque to light, such that when the casing 10 is closed, no light may enter.

The casing 10 further comprises a plurality of projections 30. The projections 30 are located on the second portion 12 of the casing 10. The projections 30 have a distal surface. Magnets 20 are mounted to the distal surface of the projections 30. The magnets 20 may be permanent magnets. The magnets 20 may be made of rare earth materials. Rare earth materials have stronger holding power than other types of magnets. The magnets 20 are used to secure ACTD 1 to an article such as a target container. Specifically, the magnets 20 are attached or mounted to a portion of a surface of the article, e.g., a ferrous surface portion. Since the ACTD 1 uses a magnetic field signature taken from two different times to determine tampering, it is important that once the ACTD 1 is mounted to the surface of the article, that the ACTD 1 does not move under any conditions. Therefore, in an aspect of the disclosure, the magnets 20 are of sufficient strength to resist rocking, swaying or movement due to environmental conditions such as wind, rain and/or snow. For example, a neodymium magnet may be used. One such neodymium magnet may be obtained from McMaster-Carr®, part No. 5679K16. This magnet is made from neodymium-iron-boron and has a steel casing. The steel case focuses and concentrates the magnetic field produced. The magnet has a center opening for mounting. For example, a fastener such as a screw 35 may be used to attach the magnet 20 to the projection 30. The screw may be a hex head screw. Additionally, a bolt, an adhesive or other type of fixing device may be used to attach the magnet 20 to the projection.

Figure 2:
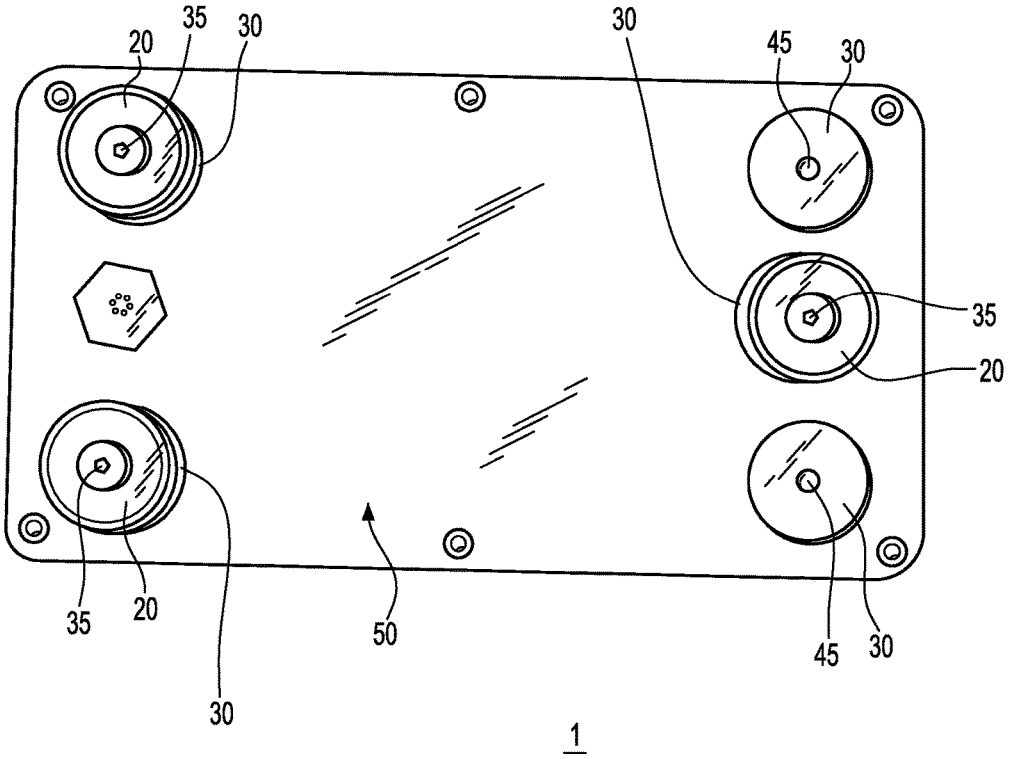
FIG. 2 is an illustration showing an example of an authenticatable container tracking device in accordance with aspect of the disclosure, showing a side of the device facing the container when attached.

The number of magnets, the shape, the location and alignment may be determined based on the surface of the target article, e.g., the irregularity and shape. For example, FIG. 2 shows three circular magnets. However, the number of magnets 20 mounted to the projections 30 may not be three and may be based on the size and shape of the ACTD 1 and the type of magnets used (material) and other shapes may be used instead, such as a bar. For example, a different number of magnets 20 may be used where a surface of a target article is generally planar.

FIG. 1 depicts the magnets 20 aligned in rows on the ends of the ACTD 1. However, other alignments may be used such as a triangular alignment or a trapezoidal alignment. FIG. 1 also depicts the magnets 20 near the edge of the casing 10. However, magnets 20 may be attached at different positions such as in a center.

Figure 3:
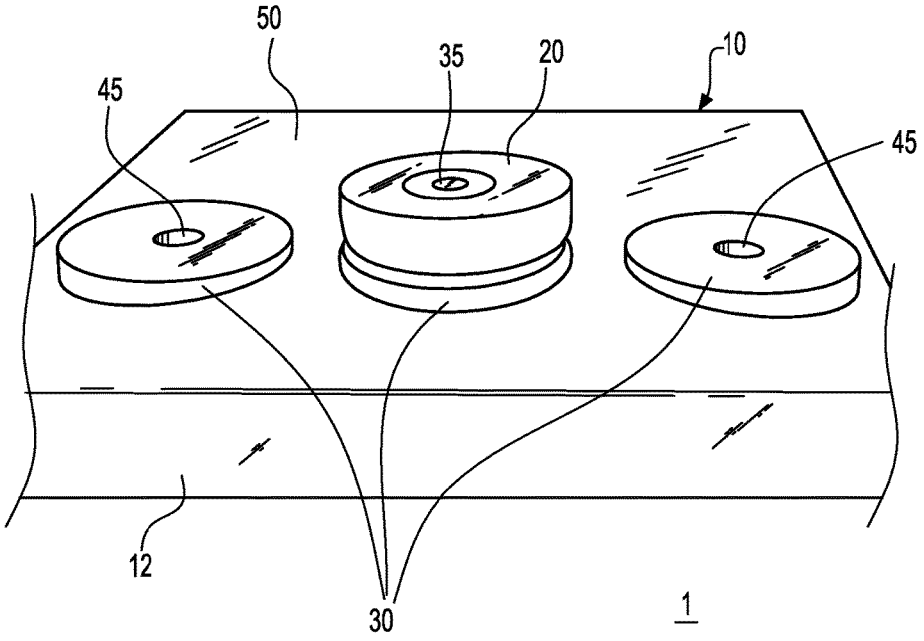
FIG. 3 is an illustration showing a partial view of an example of an authenticatable container tracking device in accordance with aspect of the disclosure showing a magnet mounted to a projection.

FIGS. 2 and 3 are illustrations of an example of an ACTD 1 having three magnets 20. FIG. 2 shows a surface 50 of the ACTD 1 which faces the article. The projections 30 also have openings 45. These openings 45 correspond to the openings in the magnets 20. When the openings 45 are aligned with the openings in the magnets 20, a fastener such as a screw 35 may be inserted into both openings to attach the magnet 20 to the ACTD 1. The opening 45 may have threading to accept the threading in the screw 35.

The partial view illustration of FIG. 3 shows one magnet 20 mounted to the ACTD 1. As can be seen in the illustrations, the projections 30 are angled relative to the surface 50. This is to allow the magnets 20, when mounted to an article, to have an increased surface area in contact with the surface of the article. This is particularly helpful when the surface of the article has an irregular shape or is convex or concave curved. For example, a container holding uranium hexafluoride typically has a curved convex surface.

Additionally, as shown in FIGS. 1-3, the screw 35 is inserted into a central portion of the magnet. This enables the magnet 20 to gimbal or rotated to contour to a curved surface. Thus, alone or in combination with the angle of the projection 30, the mounting of the magnet 20 to the ACTD 1 secures the ACTD 1 to a surface of the article with a maximum holding force and stability.

Figure 4:
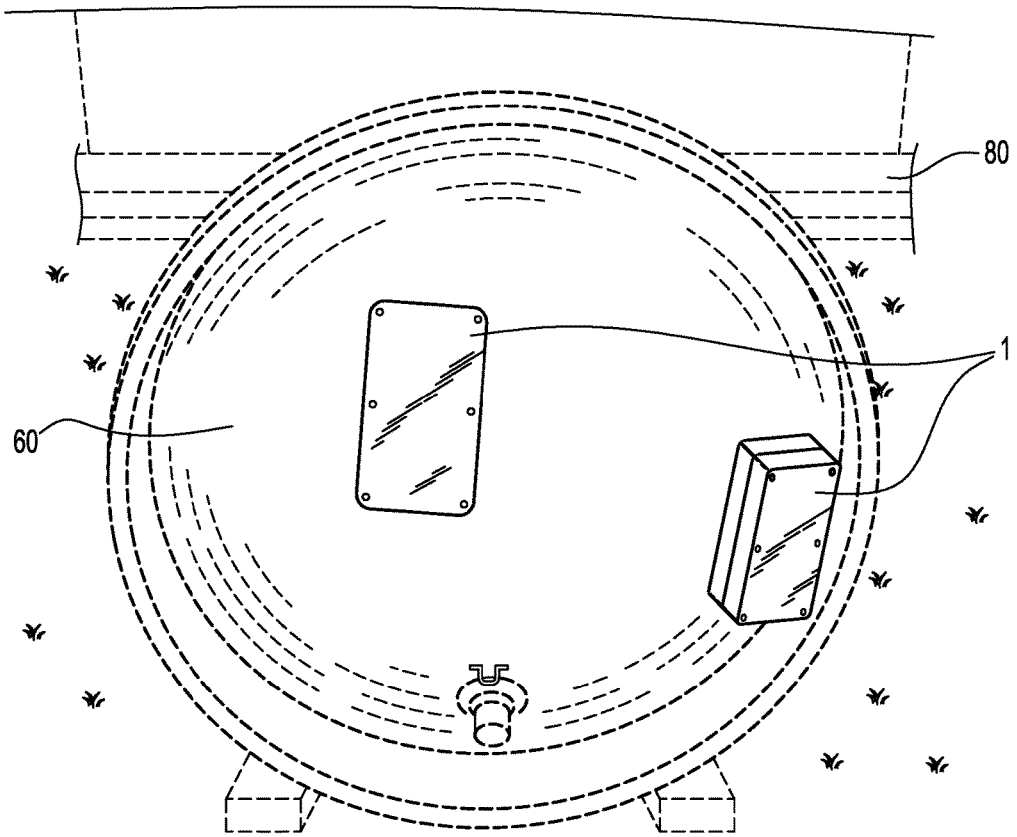
FIG. 4 is an illustration showing an example of an authenticatable container tracking device mounted to a container in accordance with aspects of the disclosure.

FIG. 4 is an illustration showing an example of a plurality of ACTDs mounted to a container 60. This container 60 is similar to a container holding uranium hexafluoride. As depicted in the illustration, the container 60 is located outside (e.g., example of an environment 80). The surface of the container is curved. One of the ACTDs is mounted to a central portion of the surface and another ACTD is mounted at an edge of the surface. The magnets 20 (and associated mounting) cannot be seen in this illustration.

In another aspect of the disclosure, the magnet 20 may be customized to a particular surface of article. For example, the magnet 20 may be manufactured using a magnetic powder and 3-D printing techniques. In an aspect of the disclosure, the surface of the article, e.g., container surface, may be digitally scanned to create a cloud mapping of the surface. The magnet's 20 shape is designed using CAD to be complimentary to the shape of the surface of the article. For example, the surface of the magnet facing the surface of the article is complimentary to the surface of the article. In an aspect of the disclosure, since the ACTD 1 comprises multiple magnets, the surface of the magnet facing the surface of the article may be different depending on the location on the ACTD 1 and the attachment location on the article. Therefore, even where the surface of the article is curved or irregular, the ACTD 1 may be securely attached to the article to limit any rocking or motion once attached.

Figure 5:
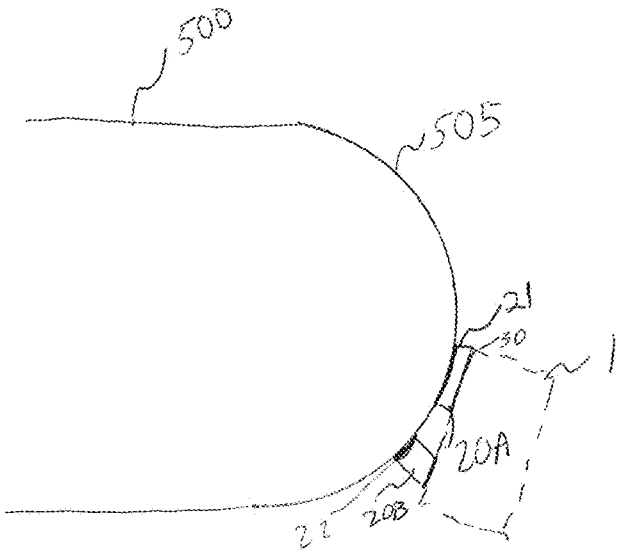
FIG. 5 depicts a sectional view of an authenticatable container tracking device mounted to a container in accordance with aspects of the disclosure.

FIG. 5 depicts a sectional view of ACTD 1 with customize magnets (20A and 20B) mounted to a container 500 (an example of an article). The container 500 comprises a convex curved surface 505. At least a portion of the curved surface 505 is made of a ferrous material such that the magnets (e.g., 20A and 20B) are attachable. As depicted, the magnets 20A and 20B are mounted on different positions on the ACTD 1. Given these different positions, the attachment location to the curved surface 505 is different at each magnet location. The shape of the magnets 20A and 20B are different from one another. Specifically, the shape of the surface 21 of magnet 20A which faces the curved surface 505 is different from the shape of the surface 22 of magnet 20B which faces the curved surface 505. Both magnets 20A and 20B may be attached using projections 30. The shapes of surfaces 21 and 22 are complimentary to the shape of the curved surface 505 at the mounting location.

In this aspect of the disclosure, since the shapes of the surfaces 21 and 22 are complementary to the shape of the curved surface 505, projections 30 may be omitted. Additionally, since the shapes of the surfaces 21 and 22 are complementary to the shape of the curved surface 505, when projections 30 are used, the projections may or may not be angled. The magnets (e.g., 20A and 20B) may be attached using screws or other attachment means at other positions than the center of the magnets.

By having the shapes of the surfaces 21 and 22 complementary to the shape of the curved surface 505, when the magnets (e.g., 20A and 20B) are attached to the curved surface 505, the magnets (e.g., 20A and 20B) are flush with the curved surface 505. This maximizes the surface area of the magnets in contact with the curved surface 505 further providing for a secured mounting without rocking or movement.

Figure 6:
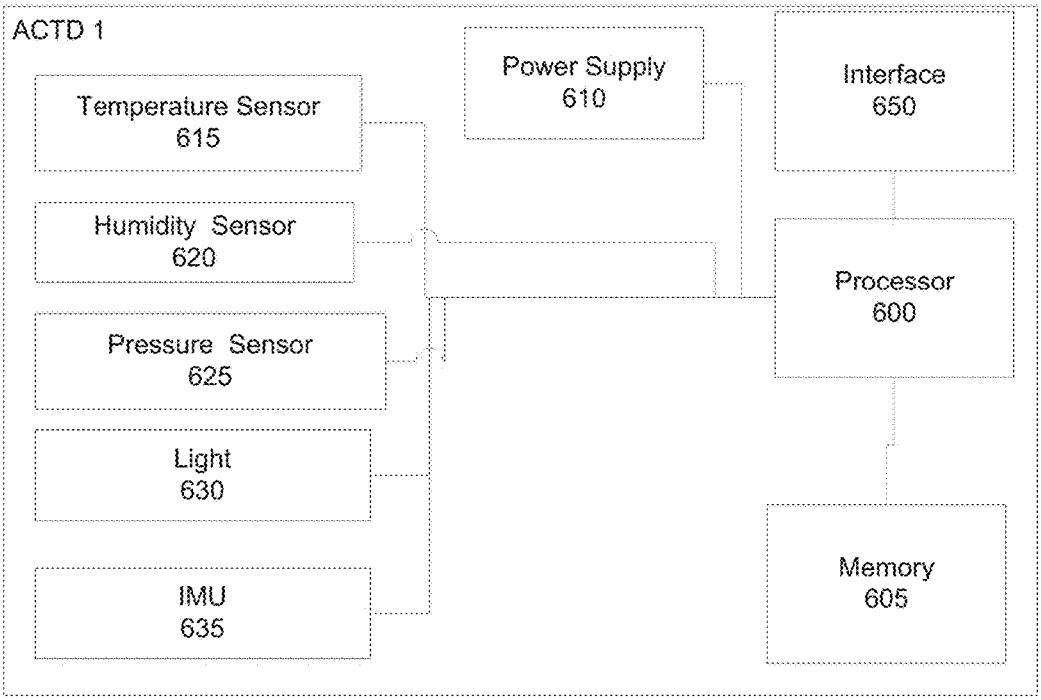
FIG. 6 depicts a block diagram of an authenticatable container tracking device in accordance with aspects of the disclosure.

FIG. 6 depicts a block diagram of ACTD 1 in accordance with aspects of the disclosure. The ACTD 1 comprises a processor 600, memory 605, a power supply 610, a plurality of sensors/detectors, such as a temperature sensor 615, a humidity sensor 620, a pressure sensor 625, a light sensor 630 and an inertial measurement unit (IMU) 635 and an interface 650.

The processor 600 may be a microcontroller (or a CPU). The microcontroller may be configured to execute one or more programs stored in a computer readable storage device such as the memory 605. The memory 605 may be, but not limited to, RAM (including FRAM and SRAM), ROM and persistent storage. The memory 605 is any piece of hardware that is capable of storing information, such as, for example without limitation, data, programs, instructions, program code, and/or other suitable information, either on a temporary basis and/or a permanent basis. While the processor 600 and memory 605 are shown as separate elements, the processor 600 and memory 605 may be packaged as a single chip. For example, a mixed signal microcontroller having onboard memory may be used. Such a microcontroller is available from Texas Instruments, Inc.®, part no. MSP430FR59xx.

The temperature sensor 615, the humidity sensor 620, the pressure sensor 625 and the light sensor 630 are environmental sensors sensing the conditions of the surrounding environment. The temperature sensor 615 may be a thermally sensitive resistor (either a negative temperature coefficient (NTC) thermistor or a positive temperature coefficient (PTC) thermistor). In another aspect of the disclosure, the temperature sensor 615 may be a resistance temperature detector (RTD), such as a platinum RTD. In another aspect of the disclosure, the temperature sensor 615 may be a thermocouple.

In another aspect of the disclosure, the temperature sensor 615 may be semiconductor based and comprise an integrated circuit (IC).

Like with the temperature sensor 615, several different types of humidity sensors may be used for the humidity sensor 620. For example, the humidity sensor 620 may be a capacitive humidity sensor. In another aspect of the disclosure, a resistive humidity sensor may be used. Resistive humidity sensors have a change in impedance due to a change in humidity. The resistive humidity sensor may comprise a hygroscopic medium. In another aspect of the disclosure, a thermal conductivity humidity sensor may be used.

While the temperature sensor 615 and the humidity sensor 620 are shown as separate elements, the temperature sensor 615 and humidity sensor 620 may be packaged as a single chip. One such combination is available from Silicon Labs®, part no. Si7020-A10. This device is a CMOS IC integrating humidity and temperature sensing elements.

Several different types of pressure sensors may be used for the pressure sensor 625. The pressure sensor (barometer) may be a piezoresistive sensor or a MEMS sensor. In other aspects of the disclosure, the pressure sensor may be capacitive, electromagnetic or piezoelectric.

The pressure sensors may be used to determine an attempted tampering of the ACTD 1, such as opening of the ACTD 1. In an aspect of the disclosure, the ACTD, when closed is pressurized. When the casing 10 is opened, the pressure drops to an ambient pressure. A pressure measurement is sent via the communication bus to the processor 600. When a change in pressure is detected, e.g., change to ambient pressure, the processor 600 generates an alert.

Several different types of light sensors may be used for the light sensor 630. For example, a photodiode may be used. One such a device is available from Maxim Integrated™, part no. MAX44009. In other aspects of the disclosure, a photo coupler may be used.

As noted above, the casing 10 of the ACTD 1 is normally opaque to light. Thus, when closed, the light sensor 630 should not detect any ambient light. However, when opened, the light sensor 630 would detect a change. Thus, the light sensor 630 may be used to determine an attempted tampering of the ACTD 1. In an aspect of the disclosure, a detection indication from the light sensor 630 is sent via the communication bus to the processor 600. When light is detected, the processor 600 generates an alert (which is stored in memory 605).

Figure 8:
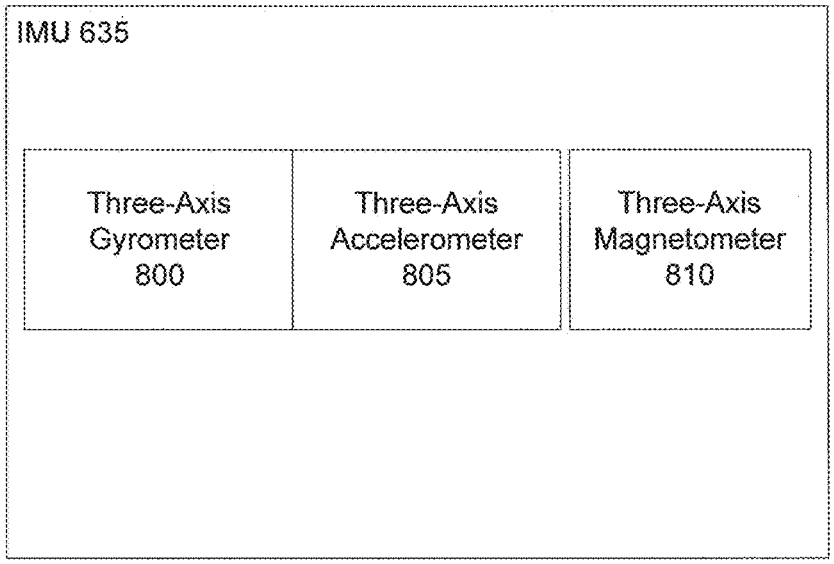
FIG. 8 depicts a block diagram of a sensing portion of an inertial measurement unit in accordance with aspects of the disclosure.

The IMU 635 may comprise a 9-axis micro-electromechanical system (MEMS). The 9-axis MEMS comprises an accelerometer, a gyrometer (also referenced herein as a gyroscope) and magnetometer. FIG. 8 depicts a block diagram of the sensing portions of the IMU 635. Each of the gyrometer 800, accelerometer 805 and magnetometer 810 is three-axis. One such device is available from InvenSense Inc., part no. MPU-9250. The full scale measurement range for the magnetometer is +−4800 μT. Thus, the strength of the magnets 20 should be selected not to saturate the magnetometer 810, but at the same time, be sufficiently high to securely hold the ACTD 1 on the surface of the article (surface of the container).

The gyrometer 800, the accelerometer 805 and the magnetometer 810 have different power modes. In sleep mode, all three of the gyrometer 800, accelerometer 805 and magnetometer 810 may be off (low) power. Additionally, each of the gyrometer 800, accelerometer 805 and magnetometer 810 may be separately powered such that one of the three may be "ON" while the others are "OFF", e.g., sleeping. For example, the accelerometer 805 may be "ON" while the gyrometer 800 and magnetometer 810 may be OFF, e.g., sleep mode. In another mode, all three of the gyrometer 800, accelerometer 805 and magnetometer 810, may be ON. In sleep mode, a first power level is used, whereas when ON, a second power level is used. The second power level is higher than the first power level and switching between modes on an as-needed basis conserves power.

While FIG. 6 shows, the gyrometer 800, the accelerometer 805 and magnetometer 810 as one IMU for brevity, each of the gyrometer 800, the accelerometer 805 and magnetometer 810 may be separate (e.g., separate package or circuit).

The three-axis magnetometer 810 senses or detects (also described herein as measures) a magnetic field signature generated by the magnets 20 of the ACTD 1, earth's magnetic field and a response to magnetic field produced by the ferrous surface portion of the article (surface of the container).

Other magnetic field detectors may be used, such as a gaussmeter.

In accordance with aspects of the disclosure, the measurements from the magnetometer 810 are used for tamper detection. Specifically, a change in the measured (sensed) magnet field signature (from initial placement) of the ACTD 1 may indicate tampering of the ACTD 1, e.g., attempted opening or removal of the ACTD 1.

In an aspect of the disclosure, measurements from the accelerometer 805 are used as a shock sensor which may confirm tampering (false alarm reduction). In an aspect of the disclosure, measurements indicating a shock event is used to trigger powering of the magnetometer 810 (and associated circuitry in the IMU 635, e.g., ON).

In an aspect of the disclosure, measurements from the gyrometer 800 may confirm tampering. In other aspects of the disclosure, measurements from other sensors, e.g., 615, 620 and 625 may also be used to confirm tampering (false alarm reduction).

In an aspect of the disclosure, the processor 600, the memory 605, the temperature sensor 615, the humidity sensor 620, the pressure sensor 625, the light sensor 630 and the IMU 635 are located on the same circuit board.

The power supply 610 may be one or more batteries. The power supply supplies power to the processor 600 (and memory 605) and the sensors under the control of the processor 600.

In an aspect of the disclosure, the power supply 610 may be rechargeable.

The interface 650 may be a wired communication interface. The interface 650 may be used when the ACTD 1 is first mounted to the surface of the article, e.g., baseline measurement session. Additionally, if the facility where the article is located does not allow for wireless communication, stored data, such as alerts may be communicated via the interface to a connected external device. Additionally, the power supply 610 may be charged via the interface 650. For example, the interface 650 may be a USB port. In an aspect of the disclosure, the interface 650 may be attached to another circuit board.

The casing 10 may have a slot (not shown) for a wire to connect to the interface 650. When the interface 650 is not in use, the slot may be covered to prevent light from entering the casing 10 or a light tight feed through connector with a dust cap.

In an aspect of the disclosure, the ACTD 1 may further comprise an expansion bus (with connectors) for a predetermined number of additional sensors and tracking devices to enhance monitoring and tracking of particular articles for specific applications such as global positioning system (GPS), gamma and neutron sensors. When additional sensors and tracking devices are used, an additional power supply may also be provided.

Figure 7:
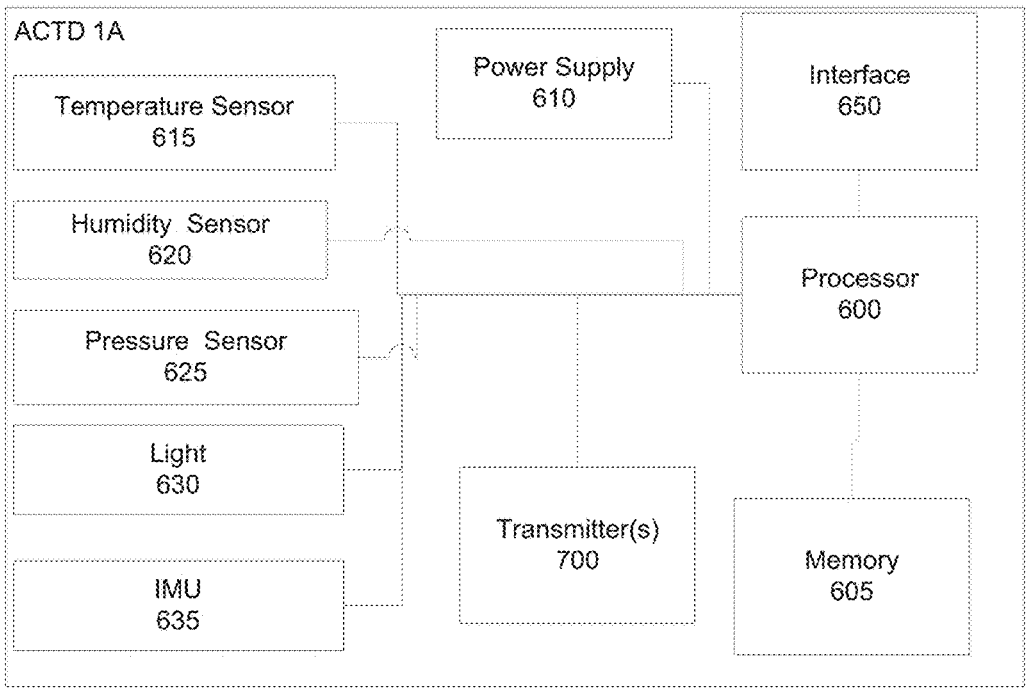
FIG. 7 depicts a block diagram of another authenticatable container tracking device in accordance with aspects of the disclosure.

FIG. 7 depicts another ACTD 1A in accordance with aspects of the disclosure. The difference between the ACTD 1 (shown in FIG. 6) and the ACTD 1A (shown in FIG. 7) is that the ACTD 1A further comprises a transmitter(s) 700. The ACTD 1A may be used where a facility allows for wireless communication. The transmitter(s) 700 may be attached to the same circuit board as interface 650. The transmitter(s) 700 may comprise one or more of: Iridium satellite communication board, GSM cellphone interface, WIFI, ultra-wideband (UWB) radio board and near-field communication (NFC). For example, ACTD 1A may comprise a DecaWave EVK1000 UWB node configured to communicate using IEEE 802.15.4 with one or more external devices, such as a base station connected to a personal computer. Other communication devices and protocols are contemplated. In other aspects of the disclosure, the ACTD 1A may comprise a receiver. The receiver may be separate from the transmitter or integrated, such as a transceiver. In accordance with these aspects, the ACTD 1A may receive instructions from a monitoring station (shown in FIG. 15). For example, the instruction may be to perform a baseline measurement session or transmit any stored data to the monitoring station.

In accordance with some aspects of the disclosure, the processor 600 may determine whether tampering has occurred using measurements from the magnetometer 810 from two different times, e.g., baseline measurement session and observation measurement session and which may be confirmed using historical measurements from environmental sensors, such as 615, 620 and 625 and the gyrometer 800. In other aspects of the disclosure, measurements are stored in the memory 605 and transmitted to an external monitoring station for evaluation.

Figure 15:
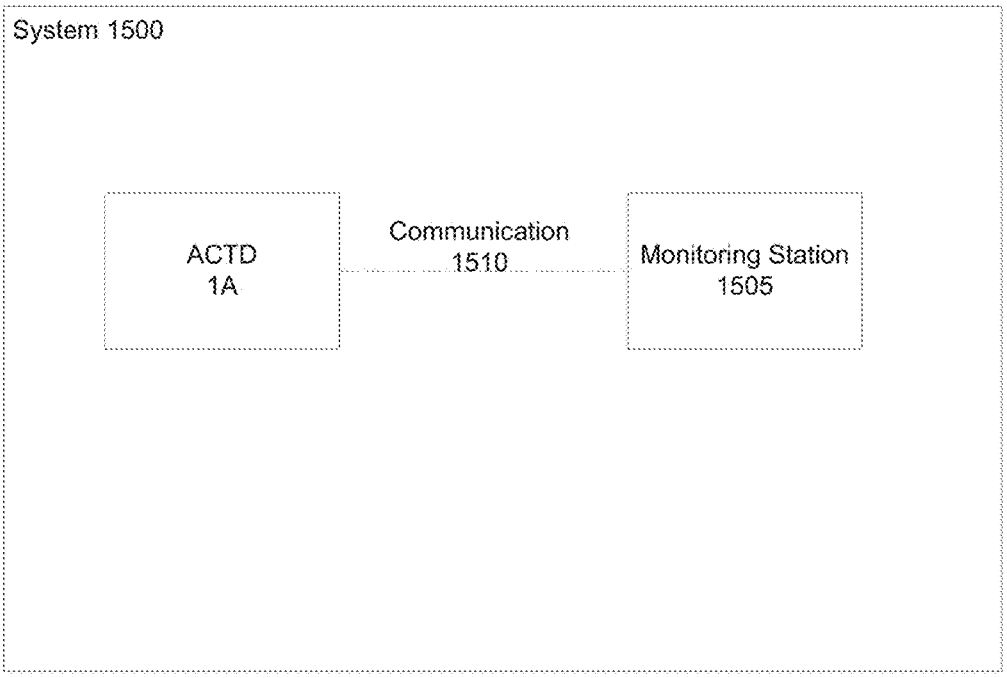
FIG. 15 depicts an authenticatable container tracking system in accordance with aspects of the disclosure.

The processor 600 (or external monitoring station), which is shown in FIG. 15, evaluates the measurements from baseline measurement session and observation measurement session using anomaly detection. In an aspect of the disclosure, principal component analysis (PCA), which is a Machine Learning-Based Approach, is used. However, this disclosure is not limited to PCA and other anomaly detection methods may be used, such as density-based anomaly detection with the k-nearest neighbors, moving average approach using discrete linear convolution and other clustering-based methods with k-means clustering algorithms.

Figure 9:
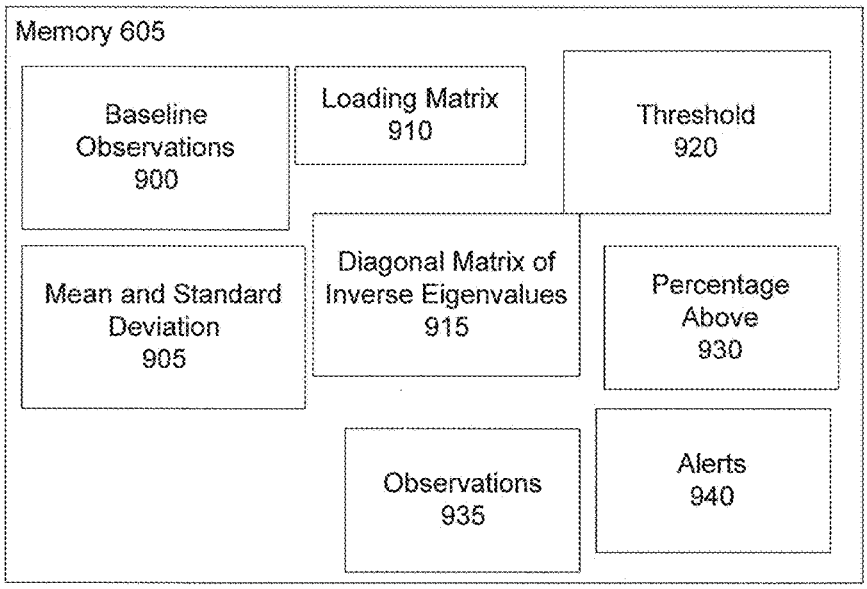
FIG. 9 depicts a block diagram of memory for the authenticatable container tracking device in accordance with aspects of the disclosure.

FIG. 9 is an example of certain data which is stored in memory 605 when PCA is used by the processor 600 to determine tampering from the measurements of the magnetometer 810. Data is stored both for the baseline measurement session and the observation measurement session.

During a baseline measurement session and processing the following is stored in memory: baseline observations 900, mean and standard deviation 905, loading matrix 910, diagonal matrix of inverse eigenvalues 915, threshold 920 and percentage of allowed values above the threshold 930. In another aspects of the disclosure, the diagonal matrix of inverse eigenvalues may not be stored in advance and calculated from the eigenvalues/eigenvectors as needed. The eigenvalues and eigenvectors may be stored. The baseline observations 900 is a working memory for the baseline measurement session. During the observation measurement session and processing, observations 935 are stored. Observations 935 is a working memory for the observation measurement session (and subsequent processing). Calculations made during the processing of the observations are also stored in observations 935. Any determined alert is also stored in memory, e.g., alert 940. When the processor 600 confirms a tampering event using measurements from the environmental sensors, e.g., 615, 620 and 625 and/or the gyrometer 800, historical measurements from the same are also stored in memory 605.

When the external monitoring station (depicted in FIG. 15) evaluates the measurements, the memory 605 stores the baseline observations 900 and the observations 935. In this case, baseline observations 900 and the observations 935 do not store any calculations or processed data.

Figure 10A:
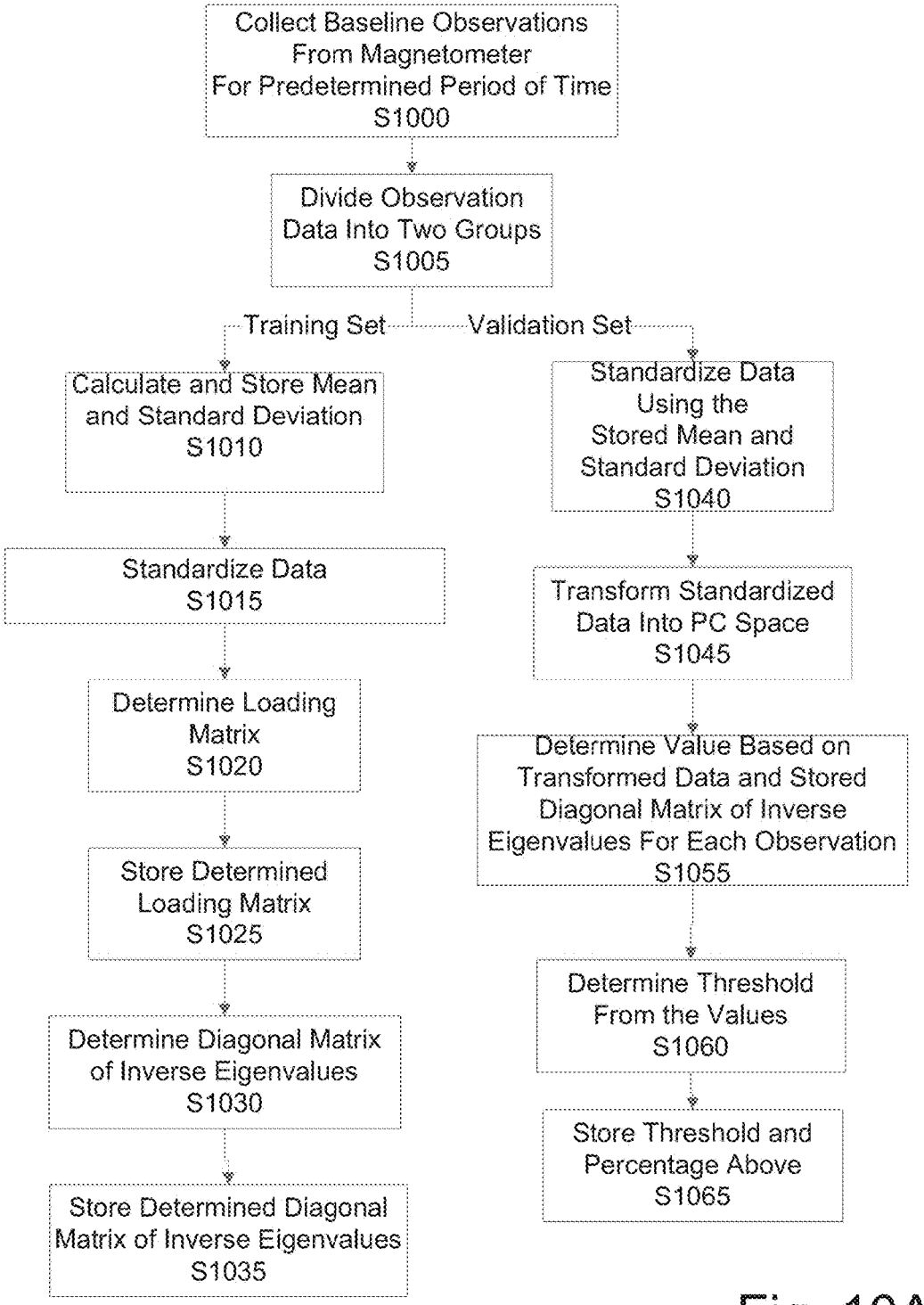
FIG. 10A depicts a flow chart for a baseline measurement session and processing in accordance with aspects of the disclosure.

FIG. 10A depicts a flow chart for baseline measurement session and processing in accordance with aspects of the disclosure. A baseline measurement session is initiated by a user when the ACTD 1 is first installed (attached) to an article, e.g., a ferrous surface of a container. The following description references ACTD 1 for descriptive purposes only, however, the ACTD 1A may also perform the baseline measurement session and processing described.

At S1000, baseline observation data, e.g., measurements of the magnetic field signature are recorded for a predetermined period of time. The processor 600 causes the magnetometer 810 to turn ON (if in sleep mode). The magnetometer 810 measures the unique magnetic field signature. The measurement is sent to the processor 600 via a communication bus. The baseline observation data is stored in baseline observations 900 in memory 605. The predetermined period of time varies based on the environment that the article is in. The period of time may be longer in a more dynamic environment and shorter in a static environment. In an aspect of the disclosure, once the predetermined period of time expires, e.g., number of observations is reached; the processor 605 may cause the magnetometer 810 to return to a sleep mode.

At S1005, the processor 600 divides the baseline observation data into two groups, one being the training set and the other being the validation set. In an aspect of the disclosure, the number of data points in each group is the same. In another aspect of the disclosure, more data points are used in the training set than the validation set. The data points for the training set and validation set are stored in the baseline observations 900 in memory 605. To ensure that the training set covers the full range of expected measurements, the maximum and minimum individual measures values for the magnetic field signature (in each axis) are included in the training set.

Once the data is separated, the training and validation sets are used creating and tuning the PCA. PCA is a linear transformation of data from an original space X with n variables representing all the columns of the input and m rows representing the observations to principal component (PC) space using a linear combination of the original n variables such that each k dimension of the new space is orthogonal to each other and the first principal component, has the maximum variance. In the ACTD 1, the original space has X, Y, and Z coordinates and n=3.

PCA is a useful technique to use whenever input data is highly collinear, as it can capture the important variance of that data set using fewer dimensions while ensuring that each dimension is orthogonal. Collinear data is anticipated for ACTS because the magnetometers 810 are three data inputs measuring the same physical phenomena.

Data is transformed into PC space using a loading matrix (loading vector).

In an aspect of the disclosure, before converting into PC space, the baseline observation data is standardized. This is done to ensure that each variable in the data receives an equal weight in the analysis regardless of units of measurement. In another aspect of the disclosure, standardization is omitted. At S1010, the mean and standard deviation of the baseline observation data is calculated (for each axis separately). Once calculated, the mean and standard deviation values for each axis are stored in Mean and Standard Deviation 905 in memory 605. The mean and standard deviation of the training set data are used to standardize all subsequent data sets including the validation set and observations from the observation measurement session(s).

At S1015, the baseline observation data is standardized using the mean and standard deviation. For example, in an aspect of the disclosure, a zscore method is used to standardize the data. Using this method results in the mean of the data set being equal to zero, and the standard deviation of the data set being equal to one. The equation for zscore standardization is shown below in Eq. 1. In this equation, each observation $x_i$ is standardized to $z_i$ by first subtracting the mean, μ, and dividing by the standard deviation, σ

$$z_i = \frac{x_i - \mu}{\sigma} \tag{1}$$

Figure 10B:
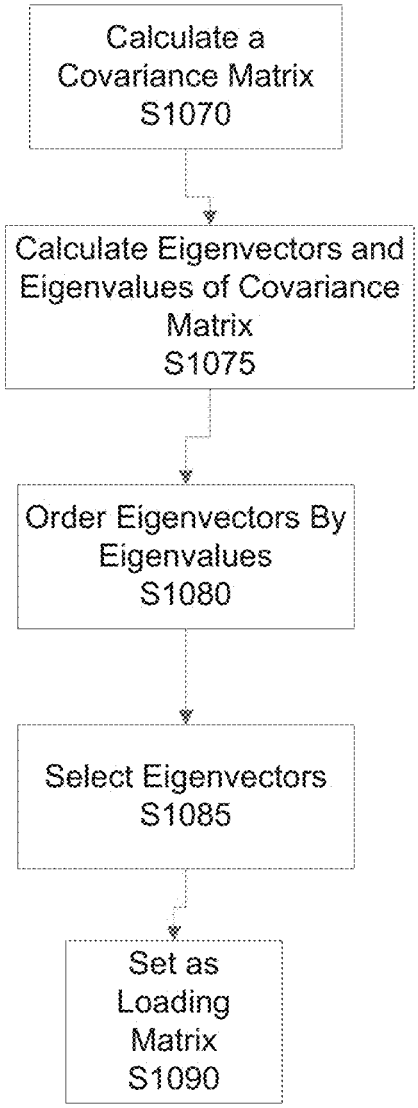
FIG. 10B depicts a flow chart for determining a loading matrix in accordance with aspects of the disclosure.

At S1020, the loading matrix for transforming the data is determined. FIG. 10B depicts a flow chart for determining the loading matrix. At S1070, the processor 600 calculates a covariance matrix. Covariance is a measurement of the linear dependence between two variables. Since the original space has X, Y, and Z axis of data (3).

The processor 600 calculates a 3×3 covariance matrix A using equation 2, as seen below. Note that cov(x,y) is equal to cov(y,x), cov(y,z) is equal to cov(z,y) and cov(x,z) is equal to cov(z,x)

$$\mathrm{cov}(A) = \begin{pmatrix} \mathrm{cov}(x, x) & \mathrm{cov}(x, y) & \mathrm{cov}(x, z) \\ \mathrm{cov}(y, x) & \mathrm{cov}(y, y) & \mathrm{cov}(y, z) \\ \mathrm{cov}(z, x) & \mathrm{cov}(z, y) & \mathrm{cov}(z, z) \end{pmatrix} \tag{2}$$

At S1075, eigenvalues and eigenvectors are calculated for the covariance matrix by the processor 600. At S1080, the eigenvectors are orders from highest to lowest eigenvalue. Given the 3×3 symmetric matrix, it is possible to calculate three eigenvector/eigenvalue pairs. There is one eigenvalue associated with each eigenvector. The ordering is to achieve the highest variance in the first principal component. Each successive principal component explains less variance than a previous principal component (e.g., ordered from highest to lowest).

Figure 11:
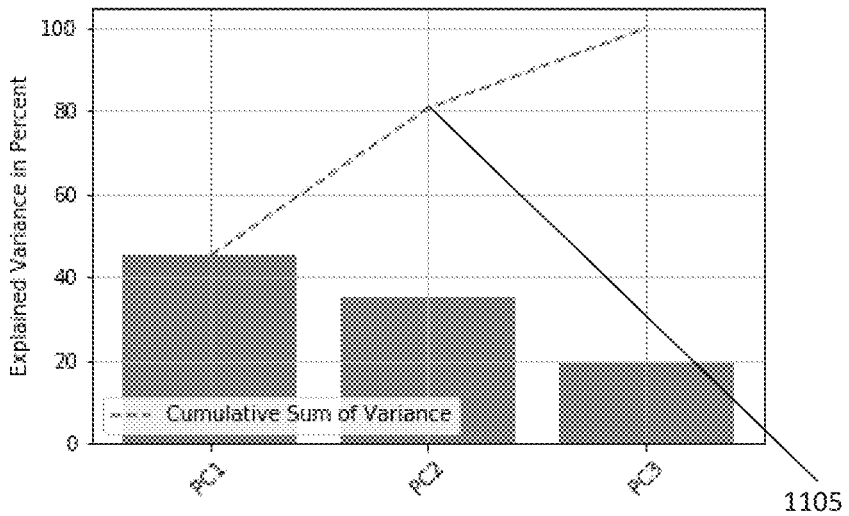
FIG. 11 depicts a graph of an example of the variance explained using successive principal components in accordance with aspects of the disclosure.

At S1085, the processor 600 selects a certain number of eigenvectors. The number of eigenvectors selected is based on a desired amount of the variance in the original space being represented in the transformation into PC space. The maximum number of eigenvectors equals the number of variables in the original space, e.g., 3, in this case. The number of selected eigenvectors reflects the number of principal components. FIG. 11 depicts an example of principal components and explained variance graph 1100. The x-axis of the graph is the principal components, e.g., PC1-PC3 and the y-axis of the graph is explained variance in percent. PC1-PC3 were determined from test data where the ACTD 1 was tested on a container. The dashed line 1105 is a cumulative percentage of explained variance for the PC. The individual bars show the variance explained by each individual principal component. As can be seen from the graph, 80% of the variance may be explained using two principal components for observations used in the training set for the test data. However, the percentage explained by the individual principal components may change based on the measured values of the observations in the training set. In an aspect of the disclosure, two principal components are used. Thus, at S1085, the processor 600 selects two eigenvectors, e.g., the two eigenvectors that respectively have the highest associated eigenvalue.

At S1090, the processor sets the selected eigenvectors as the loading matrix. Referring back to FIG. 10A, at S1025, the loading matrix is stored in memory 605 (in Loading Matrix 910).

The same loading matrix 910 is used to transform the validation set and the observation measurements into PC space.

Additional parameters are also determined using the baseline observation data such as a diagonal matrix of inverse eigenvalues. Anomalies in PC space may be detected using one or more statistical analysis techniques to find transformed observations that are outliers to the rest of the transformed observation data. For example, a Hotelling's $T^2$ statistic or a Q residual statistic may be used. Hotelling's $T^2$ statistic (hereinafter "$T^2$" or "$T^2$ statistic") does this by measuring how far a specific observation is from the center of the data in PC space. A $T^2$ statistic calculated based on the diagonal matrix of inverse eigenvalues associated with the loading matrix. When $T^2$ is used, at S1030, the processor 600 determines the diagonal matrix of inverse eigenvalues. The diagonal matrix of inverse eigenvalues is determined using the eigenvalues calculated in S1075.

At S1035, the diagonal matrix of inverse eigenvalues is stored in memory 605 (in diagonal matrix of inverse eigenvalues 915).

Once the above parameters are determined, the processor 600 moves to the validation set, e.g., S1040.

At S1040, the processor 600 standardizes each observation using the mean and standard deviation 905 stored in memory 605, e.g., determined using the training set, using equation 1. The standardized data points are stored in baseline observations 900.

At S1045, the processor 600 transforms each standardized observation into PC space. The transformation uses the loading matrix determined in FIG. 10B and stored in memory 605 (as loading matrix 910). The transformation uses the following equation, where T is an m by k matrix, X is a m by n matrix, and P is an n by k matrix, and m is the number of observations, k is the dimensionality of the PC space (two in this case), and n is the dimensionality of the original space (three because the original space includes an X, Y, and Z axis for the magnetometer 810):

$$T=XP \tag{3}$$

The result of the transformation is a score matrix. The score matrix is stored in memory 605 (in baseline observations 900). The score matrix has the transformed values for each observation in an all in one matrix, where the number of rows equals the number of observations and the number of columns equals the number of principal components used.

At S1055, the processor 600 calculates a $T^2$ statistical value for each observation representing the distance of that value from the center of the observations in PC space. This statistical value is calculated for each observation using the following equation. In this equation, $t_i$ is the individual observation from the score matrix with values for the principal components, e.g., PC1 and PC2, $\lambda^{-1}$ is the diagonal matrix of inverse eigenvalues from memory 915 (or calculated as needed from the eigenvalues and eigenvectors), and $t_i^T$ is the transpose of the individual observation from the score matrix.

$$T_i^2=t_i\lambda^{-1}t_i^T \tag{4}$$

The individual observation from the score matrix is a 1×2 matrix and thus the transpose of the individual observation is a 2×1 matrix. The diagonal matrix of inverse eigenvalues is a 2×2 matrix. The resultant matrix multiplication determines one value. This calculation is repeated for each observation in the measurement session.

At S1060, the threshold is determined from the $T^2$ value of each observation in the validation set. The threshold is set by balancing a false alarm rate against the probability of non-detection. A lower threshold could result in a high false alarm rate, whereas a higher threshold could result in non-detection.

Figure 12:
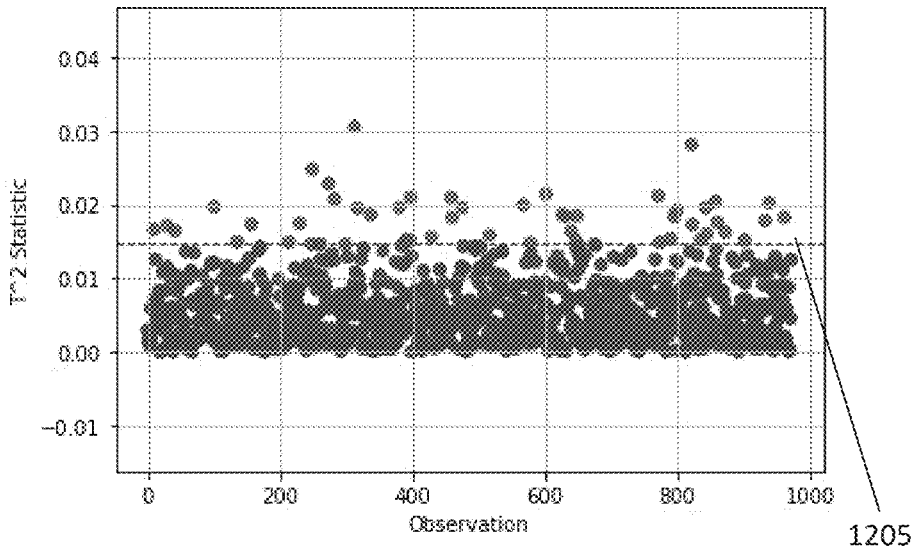
FIG. 12 depicts a graph showing an example of a value determined for each observation point in an example of a validation set and an example of a threshold in accordance with aspects of the disclosure.

FIG. 12 illustrates a graph 1200 showing examples of observations verses the $T^2$ statistic and threshold determination. The x-axis is the observation number and the y-axis is the calculated $T^2$ statistic from the validation data. The points on the graph are the $T^2$ values for each observation. The dashed line 1205 indicates an example of a threshold. As depicted in FIG. 12, the threshold was determined by accepting 95% of the values from the validation set as being below the threshold (5% were allowed to be above). The threshold, e.g., dashed line 1205, shown in FIG. 12 is only an example and other thresholds may be determined for the same data (or different data). In an aspect of the disclosure, the threshold may be different for different applications. For example, the shape of the target surface may impact the threshold.

At S1065, the processor 600 stores the threshold and percentage allowed above the threshold in memory (in Threshold 920 and Percentage Above 930). In the example depicted in FIG. 12, the threshold would be set to approximately 0.15 and the percentage allowed above the threshold is 5%.

In aspects of the disclosures, the processor 600 determines tampering based on the magnetic field signature either based on a trigger from shock (measurement of the accelerometer 805) or periodically over time.

Figure 13:
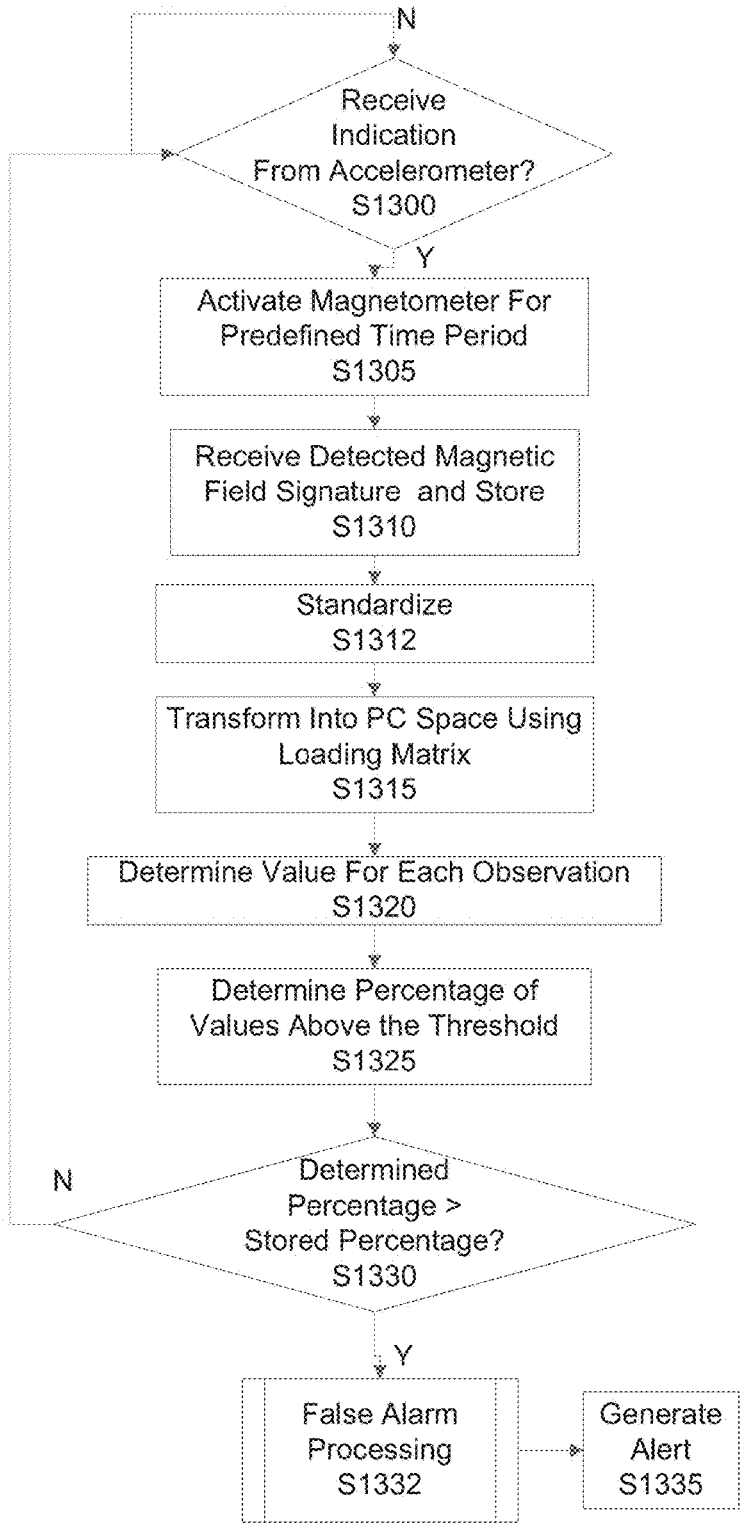
FIG. 13 depicts a flow chart for a shock triggered measurement session in accordance with aspects of the disclosure.

FIG. 13 depicts a flow chart for a shock triggered measurement session in accordance with aspects of the disclosure. The processor 600 receives indication from the accelerometer 805 at S1300. This indication indicates that the ACTD 1 received a shock event, e.g., measurement of the accelerometer 805 is greater than a preset threshold. The indication may cause the processor 600 to wake up from a sleep mode. In an aspect of the disclosure, to save power, the processor 600 between measurement sessions, enters a sleep or low power mode. In an aspect of the disclosure, when the processor 600 does not receive the indication ("N" at S1300), the processor 600 may remain in sleep mode.

When a shock has occurred to the ACTD 1 ("Y" at S1300), the processor 600 activates the magnetometer 810 for a predefined time period at S1305. A second level of power is supplied to the magnetometer 810 and it awakens from sleep mode. The predefined time period depends on the environment in which the ACTD 1 (and article) is located. The more diverse the environment is, the longer the time period may be.

At S1310, the processor 600 receives measured (detected) magnetic field signatures (for the three-axis) from the magnetometer 810. The magnetic field signature is stored in memory 605 (in Observations 935). As noted above, the magnetic field signature is a unique combination of the magnetic field generated by the magnets 20, the earth's magnetic field and a response to the magnetic field by the ferrous surface of the article. Thus, once attached, the magnetic field signature is unique to the combination of the ACTD 1. Movement of the ACTD 1 with respect to the article, e.g., container, changes the unique magnetic field signature. In an aspect of the disclosure, once the processor 600 receives the magnetic field signature for all of the observations in the predefined time period, the processor 600 may cause the magnetometer 810 to return to a sleep mode. To conserve power, the power consumption in sleep mode is lower than when the magnetometer 810 is ON. In other aspects of the disclosure, the processor 600 may wait to cause the magnetometer 810 to return to sleep mode until S1330 ("N").

At S1312, the processor 600 standardizes each observation using the mean and standard deviation 905 stored in memory 605, e.g., determined using the training set, using equation 1. The standardized data points are stored in observations 935.

At S1315, the processor 600 transforms each standardized observation into PC space. The transformation uses the loading matrix determined in FIG. 10B and stored in memory 605 (as loading matrix 910). The transformation uses the equation 3.

The result of the transformation is a score matrix containing the transformed values for all of the observations. The score matrix is stored in memory 605 (in observations 935).

At S1320, the processor 600 determines a value representing the distance of that value from the center of the observations in PC space, e.g., $T^2$, using equation 4. As noted in FIG. 13, the value is determined for each observation in the observation measurement session.

At S1325, the processor 600 compares each of the determined values (for the observation data) with the stored threshold 920. Each time a determined value (e.g., $T^2$ for an observation) is greater than the threshold 920, the processor 600 increments a counter. The counter starts at zero and increases by 1 each time the determined value (e.g., $T^2$ for an observation) is greater than the threshold 920. When a final observation is compared with the threshold 920, the value in the counter is stored in memory 605 (stored in observations 935).

The processor 600 determines a percentage of observations that exceeds the threshold. In an aspect of the disclosure, the processor 600 divides the number in the counter by the total number of observations (in the observation measurement session) to obtain a percentage.

At S1330, the processor 600 compares the determined percentage of observations that exceeds the threshold with the percentage of allowed values stored in 930 (in memory).

When the determined percentage of observations that exceeds the threshold is greater than the percentage of allowed values stored in 930, the processor 600 may perform false alarm processing at S1332. False alarm processing will be described later. False alarm processing tries to reduce a likelihood of a false alarm. A false alarm is where the magnetic field signature changed but the change was not caused by tampering. For example, the change may have been due to an unexpected change in the environment that was not accounted for during baseline observation processing.

In other aspects of the disclosure, false alarm processing may be omitted and, when the determined percentage of observations that exceeds the threshold is greater than the percentage of allowed values stored in 930, the processor 600 generates an alert in S1335. The alert may comprise a unique header, a time of the observation session, the measured magnetic field signature and an indication of the change. In other aspects of the disclosure, the alert may comprise the measured values from all of the sensors from the measurement session (e.g., sensors 615-630, gyrometer 800 and accelerometer 805. The indication of the change may be a set flag. The unique header indicates that the "data" is an alert.

Figure 14:
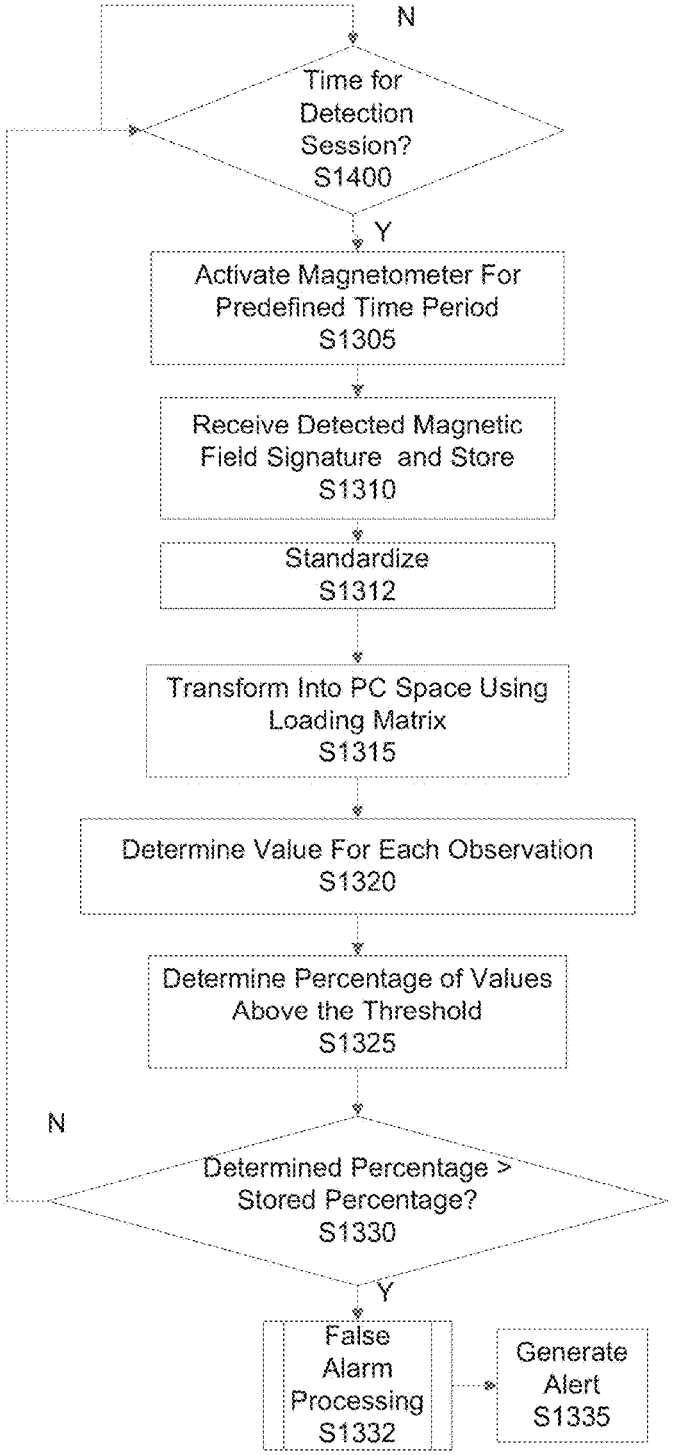
FIG. 14 depicts a flow chart for periodic measurement session in accordance with aspects of the disclosure.

FIG. 14 depicts a flow chart for a periodic triggered measurement session in accordance with aspects of the disclosure. The flow chart depicted in FIG. 14 is similar to that of FIG. 13, therefore S1305-S1335 will not be described again in detail. The difference is S1400. Instead of the observation measurement session being triggered by a shock event, the observation measurement session periodically occurs. The term periodic or periodically used herein may include the same time period between observation sessions or a different time period between each observation measurement session. The time period between measurement sessions may be set when the ACTD 1 is installed. In other aspects of the disclosure, the time period is determined when an observation measurement session (and processing) is completed. In an aspect of the disclosure, the time period between observation measurement sessions depends on the environment in which the ACTD 1 (and article) is located. The more diverse the environment is, the shorter the time period between measurements may be. Additionally, the time period between measurements may be set based on the application, e.g., what is the article is (or what is inside the container). For example, when the article or container contains uranium hexafluoride, the time period between measurements is set to be short. In an aspect of the disclosure, the time period between observation measurement sessions may be randomized such that the next occurrence of the observation measurement session cannot be predicted by a person, e.g., the value for the time period stored in memory 605 would be changed each measurement session based on a random number generator. For example, when the processing of the observations from the measurement session is complete, the processor 600 determines the time period (wait time) for the next measurement session. The processor 600 uses the random number generator and replaces the time period stored in memory 605 with the new time period. In an aspect of the disclosure, after storing the time period, the processor 600 returns to a sleep mode and wakes up based on the time period newly stored in memory 605. The time period between measurements balances the life of the power supply and security. The shorter the time period between measurements is, the shorter the life of the power supply, e.g., battery may need to be replaced/recharged.

If the ACTD 1 needed to be removed from the surface of the article (container) for any reasons (such as to change the battery), the baseline measurement session would likely need to be performed again.

In accordance with this aspect of the disclosure, the time period between measurements (not shown in FIG. 9) is stored memory 605. The processor 600 comprises a clock or timer to track the time period between measurements. For example, when the baseline measurement session is complete and the parameters are determined for the baseline observations in the baseline measurement session (e.g., Loading Matrix 910, Mean and Standard Deviation 905, Diagonal Matrix of Inverse Eigenvalues 915, Threshold 920 and percentage of allowed values above 930), the processor 600 may set the clock or timer to the maximum time period between measurements using the set time period. The clock or timer counts down the time to zero. When the clock or timer reaches zero, it is time to trigger the observation measurement session.

At S1400, the processor 600 determines whether the time on the clock or timer is greater than zero. When the time on the clock or timer is greater than zero ("N" at S1400), it is not time for the observation measurement session and the processor 600 waits at S1400. When the time on the clock or timer equals zero ("Y" at S1400), the processor 600 activates the magnetometer 810 at S1305 to take measurements. The remaining flow is similar to FIG. 13 and will not be described in detail again.

The triggering of the observation measurement session may be based on both shock and the set time period between measurements. For example, even if it is not time to have an observation measurement session, e.g. time on the clock or timer is greater than zero, when a shock event occurs, the processor 600 activates the magnetometer 810 (at S1305).

FIG. 15 depicts an authenticatable container tracking system (ACTS) 1500 in accordance with aspects of the disclosure. The ACTS 1500 comprises the ACTD 1A (described above) and a monitoring station 1505. The ACTD 1A and the monitoring station 1505 may communication over a wired or wireless transmission 1510. In an aspect of the disclosure, the monitoring station 1505 may be located within a facility where the article is located, such as a local base station (e.g., within the same building). Alternatively, the monitoring station 1505 may be remote from the facility where the article is located. In other aspects of the disclosure, the monitoring station 1505 may serve as a relay of data to an additional monitoring station. For example, the monitoring station 1505 may be physical connected to another device such as a personal computer. The personal computer may process the data and/or further relay the data (and processed data) to another device via the Internet, a satellite network or other means.

In an aspect of the disclosure, the processor 600 may transmit the generated alerts to the monitoring station 1505 via communication 1510. The processor 600 causes one of the transmitters 700 to transmit a signal to the monitoring station 1505. The signal comprises the unique header indicating an alert. The alert comprises the information described above.

In other aspects of the disclosure, the ACTD 1A does not execute the processing of the baseline observations and the observations from the observation measurement session. Instead, the ACTD 1A collects the measurement data from the sensors (both baseline observations and observations from the observation measurement session) and stores the same. The processor 600 causes the transmitter to transmit the measurement data to the monitoring station 1505 via communication 1510. In this aspect, memory 605 only includes baseline observations 900 and observations 935. The remaining data is stored in the memory of the monitoring station.

The monitoring station 1505 executes S1005-1065 in FIG. 10A, S1070-1090 in FIG. 10B and S1312-1335 in FIGS. 13 and 14. The ACTD 1A executes S1000 in FIG. 10A, S1300-1310 in FIG. 13 and S1400, S1305 and S1310 in FIG. 14.

Figure 16:
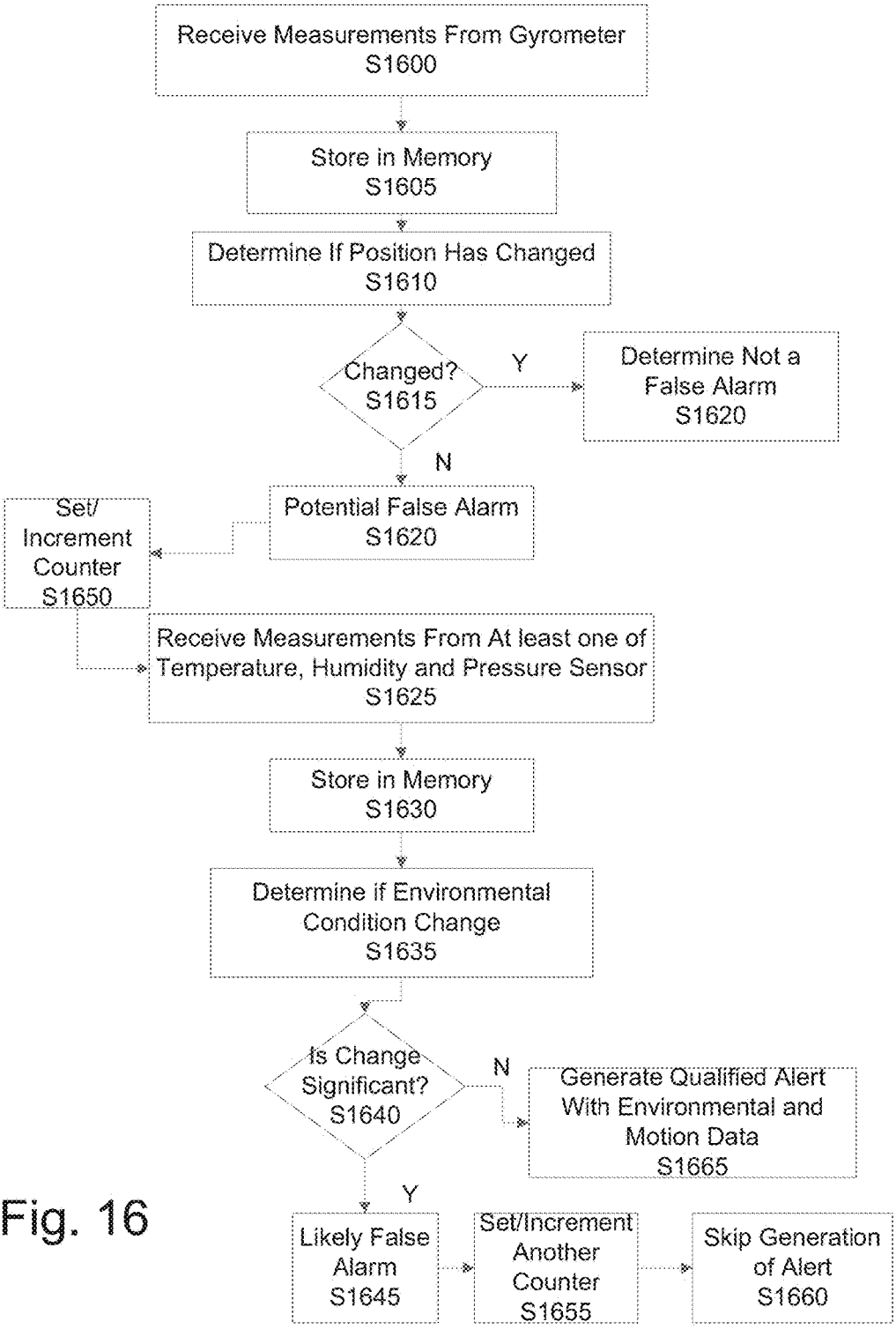
FIG. 16 depicts a flow chart for false alarm processing in accordance with aspects of the disclosure.

FIG. 16 depicts a flow chart for false alarm processing in accordance with aspects of the disclosure. The false alarm processing uses measurements from other sensors to confirm whether a tampering event has occurred. For example, measurements from the gyrometer 800, the temperature sensor 615, the humidity sensor 620 and the pressure sensor 625 may be used to confirm tampering or suggest a false alarm. The false alarm processing uses measurements from at least two different periods of time, e.g., historical measurements from the respective sensors. The number of successive periods of time used depends on the size of the memory 605 as the historical data is stored in memory 605. The frequency of receipt of the measurements may be based on the same periodic trigger of the observation measurement session for the magnetometers. When a shock is used to trigger the observation measurement session, the measurements from the gyrometer 800, the temperature sensor 615, the humidity sensor 620 and the pressure sensor 625 may be received based on different set periods of time, e.g., hourly. In an aspect of the disclosure, the set periods may depend on the environment in which the ACTD 1 (ACTD 1A) (and article) is located. The more diverse the environment is, the shorter the time period between measurements may be. Additionally, the set periods may be based on the application, e.g., what is the article is (or what is inside the container). Additionally, the set periods may be randomized such that the time period between measurements is changed each time a measurement is made.

At S1600, the processor 600 receives measurements from the gyrometer 800. These measurements are stored in memory 605 at S1605. Once at least two sets of measurements are received, the processor 605 can compare the measurements from the at least two different times at S1610. If there is a change in the magnetic field signature that resulted in "Y" at S1330, prior to receiving at least two sets of measurements, the false alarm processing S1332 may be skipped.

At S1615, the processor 600 determines whether there is a change in the measurements, e.g., position has changed. When the position has changed ("Y" at S1615), the processor 600 confirms that a tampering event may have occurred at S1620. The processor 600 determines that the results of the magnetometer 810 are not a false alarm and the alert is generated as S1335.

When the position has not changed ("N" at S1615), the results of the magnetometer may be a false alarm (e.g., potential false alarm). For example, the change in the magnetic field signature may be attributed to a change in environment. The potential false alarm is recorded in memory 605 at S1620 and the processor 600 sets a counter at S1650 or increments a counter, if counter value is greater than zero. The counter is used to determine whether the PCA needs to be updated via a new baseline measurement session.

At S1625, the processor 600 receives measurements from at least one of the temperature sensor 615, the humidity sensor 620 and the pressure sensor 625. These measurements are stored in memory 605 at S1630. Once at least two sets of measurements (from the same sensor) are received, the processor 600 can compare the measurements from the at least two different times at S1635. If there is a change in the magnetic field signature that resulted in "Y" at S1330, prior to receiving at least two sets of measurements (from the same sensor), a qualified alert may be generated. The qualified alert indicates that motion was not detected by the gyrometer 800 however; there was a change in the magnetic field signature that results in a "Y" at S1330. In an aspect of the disclosure, the qualified alert may cause a visual inspection of the ACTD 1 and/or article.

At S1635, the processor 600 determines whether there is a change in the measurements, e.g., temperature, humidity or pressure has changed. At S1640, the processor 600 determines whether the change in the environmental conditions is significant or in excess of a predetermined threshold. A change in an environmental condition is significant where the change impacts the performance of the magnetometer 810 or where there is an unexpected environmental condition such that the baseline measurement session did not account for the environmental condition. In an aspect of the disclosure, a change threshold is stored in memory 605. The processor 600 may use the change threshold to determine significances. When the difference between measurements is greater than the change threshold, the processor 600 determines that the change in the environmental condition is significant ("Y" at S1640). S1625-S1640 are repeated for each sensor that is used to confirm the alert.

When more than one sensor is used, if there is a significant change in any of the measurements, the process moves to S1645 otherwise, the process moves to S1665. Additionally, when more than one sensor is used, multiple change thresholds may be used. The change thresholds may be different for each sensor.

When the change in the environmental condition(s) is/are significant, it is likely that there is a false alarm (S1645). The likely false alarm is recorded in memory 605 at S1645 and the processor set another counter at S1655 or increments the another counter, if the another counter value is greater than zero. The another counter is also used to determine whether the PCA needs to be updated via a new baseline measurement session. At S1660, the processor 600 skips the generation of the alert due to the conclusion that the alert is likely a false alarm.

On the other hand, when the change in the environmental condition(s) is/are not significant ("N" at S1640), the processor 600 generates a qualified alert. Since there was no motion detected by the gyrometer 800, the alert may be potentially false. Therefore, the alert is a qualified alert. The qualified alert comprises a unique header and both the environmental measurements from the temperature sensor 615, the humidity sensor 620 and/or the pressure sensor 625 and the measurements from the gyrometer 800. The header in the qualified alert may be different from the alert (unqualified). When the qualified alert is generated, S1335 may be skipped. In an aspect of the disclosure, the qualified alert may cause a visual inspection of the ACTD 1 and/or article.

In an aspect of the disclosure, the processor 600 evaluates the counters to determine whether the baseline measurement session needs to be redone. A repeated potential false alarm and likely false alarm, suggests that the training set did not account for all potential environmental conditions and/or the baseline measurement session was not long enough. In an aspect of the disclosure, the memory 605 may comprise thresholds for the counters. When the values in the counters exceed the respective threshold, a baseline measurement session is triggered. The threshold for another counter (likely false alarm) may be set to a lower value than the threshold for the counter (potential false alarm).

In an aspect of the disclosure, the baseline measurement session may be repeated for a longer period of time. Additionally, simulated environmental conditions similar to the actual environmental conditions may be used. For example, if there was a sudden cold spell in the temperature, a cooling element may be used to simulate a colder environment.

Various aspects of the present disclosure may be embodied as a program, software, or computer instructions embodied or stored in a computer or machine usable or readable medium, or a group of media which causes the computer or machine to perform the steps of the method when executed on the computer, processor, and/or machine. A program storage device readable by a machine, e.g., a computer readable medium, tangibly embodying a program of instructions executable by the machine to perform various functionalities and methods described in the present disclosure is also provided, e.g., a computer program product.

The computer readable medium could be a computer readable storage device or a computer readable signal medium. A computer readable storage device, may be, for example, a magnetic, optical, electronic, electromagnetic, infrared, or semiconductor system, apparatus, or device, or any suitable combination of the foregoing; however, the computer readable storage device is not limited to these examples except a computer readable storage device excludes computer readable signal medium. Additional examples of the computer readable storage device can include: a portable computer diskette, a hard disk, a magnetic storage device, a portable compact disc read-only memory (CD-ROM), a random access memory (RAM), a read-only memory (ROM), an erasable programmable read-only memory (EPROM or Flash memory), an optical storage device, or any appropriate combination of the foregoing; however, the computer readable storage device is also not limited to these examples. Any tangible medium that can contain, or store, a program for use by or in connection with an instruction execution system, apparatus, or device could be a computer readable storage device.

A computer readable signal medium may include a propagated data signal with computer readable program code embodied therein, such as, but not limited to, in baseband or as part of a carrier wave. A propagated signal may take any of a plurality of forms, including, but not limited to, electromagnetic, optical, or any suitable combination thereof. A computer readable signal medium may be any computer readable medium (exclusive of computer readable storage device) that can communicate, propagate, or transport a program for use by or in connection with a system, apparatus, or device. Program code embodied on a computer readable signal medium may be transmitted using any appropriate medium, including but not limited to wireless, wired, optical fiber cable, RF, etc., or any suitable combination of the foregoing.

The terms "Processor" as may be used in the present disclosure may include a variety of combinations of fixed and/or portable computer hardware, software, peripherals, and storage devices. The "Processor" may include a plurality of individual components that are networked or otherwise linked to perform collaboratively, such as a DSP in the IMU chip and the processor 600, or may include one or more stand-alone components. The hardware and software components of the "Processor", of the present disclosure may include and may be included within fixed and portable devices such as desktop, laptop, and/or server, and network of servers (cloud).

The terminology used herein is for the purpose of describing particular embodiments only and is not intended to be limiting the scope of the disclosure and is not intended to be exhaustive. Many modifications and variations will be apparent to those of ordinary skill in the art without departing from the scope and spirit of the disclosure.

What is claimed is:

1. An authenticatable container tracking device comprising:

a non-metallic casing;

a plurality of magnets mounted to the non-metallic casing, the mounting allowing each of the plurality of magnets to conform to a ferrous surface portion of a target container, the mounting and the plurality of magnets being configured to securely attach the non-metallic casing to the ferrous surface portion of the target container, the non-metallic casing comprising:

a three-axis magnetometer having a sleep mode and an active mode, in sleep mode a first level of power is supplied to the three-axis magnetometer, in the active mode, a second level of power is supplied to the three-axis magnetometer, the three-axis magnetometer being configured to detect a magnetic field signature produced by a combination of the plurality of magnets and the ferrous surface portion of the target container and earth's magnetic field;

a shock sensor;

a processor in electrical communication with the three-axis magnetometer and the shock sensor;

a memory configured to store an alarm threshold and a percentage of allowed values above the alarm threshold, the alarm threshold and the percentage being determined during a baseline measurement session; and a power supply configured to provide power to the processor, the shock sensor and the three-axis magnetometer, the processor is configured to:

receive a detection indication from the shock sensor;

trigger the active mode for the three-axis magnetometer based on the detection indication by causing the second level of power to be supplied from the power supply;

receive detections of the magnetic field signature from the three-axis magnetometer over a measurement period;

for each detection of the magnetic field signature, the processor is configured to:

convert the detection to a value; and compare the value with the alarm threshold stored in the memory, the processor is further configured to determine a percentage of detections having the value above the alarm threshold; and compare the percentage of detections having the value above the alarm threshold with the percentage of allowed values above the alarm threshold stored in the memory, when the percentage of detections having the value above the alarm threshold is greater than the percentage of allowed values above the alarm threshold, the processor is configured to generate an alert.

2. The authenticatable container tracking device of claim 1, wherein the non-metallic casing comprises a plurality of projections, wherein each magnet is mounted to a distal surface of a respective projection.

3. The authenticatable container tracking device of claim 1, wherein each of the plurality of magnets has an attachment surface, the attachment surface being the surface of the magnet which when attached to the target container faces the ferrous surface portion of the target container, and wherein the attachment surface has a shape which is complementary in shape to the ferrous surface portion of the target container, whereby the attachment surface is flush with the ferrous surface portion of the target container when attached to the target container.

4. The authenticatable container tracking device of claim 1, wherein when the percentage of detections having the value above the alarm threshold is less than or equal to the percentage of allowed values above the alarm threshold, the processor is configured to switch the three-axis magnetometer to sleep mode.

5. The authenticatable container tracking device of claim 1, wherein the baseline measurement session is performed over a period of time producing a plurality of baseline measurement values, each baseline measurement value comprising a measured magnetic field signature for each of the three-axes.

6. The authenticatable container tracking device of claim 5, wherein the period of time depends on an environment in which the target container is located.

7. The authenticatable container tracking device of claim 5, wherein the processor is configured to determine the alarm threshold based on the plurality of baseline measurement values using anomaly detection.

8. The authenticatable container tracking device of claim 7, wherein the anomaly detection comprises a principal component analysis.

9. The authenticatable container tracking device of claim 8, wherein the processor is configured to divide the baseline measurement values into two groups, the two groups comprising a training group and a verification group, the training group comprising baseline measurement values having a minimum magnetic field signature and maximum magnetic field signature for each of the three-axes, wherein for the training group, the processor is configured to determine a loading matrix for transforming measured data into principal component space, and wherein for the verification group, the processor is configured to use the loading matrix to calculate a score matrix for each measured value in the verification group, wherein the score matrix is a transformation of each measure value into the principal component space, and calculate a value from the score matrix for each measured value in the verification group, wherein the alarm threshold is set to a specific value where a fixed percentage of the calculated values are above the specific value, and wherein the fixed percentage is the percentage above the alarm threshold stored in the memory, and wherein the loading matrix are stored in the memory.

10. The authenticatable container tracking device of claim 9, wherein the processor is configured to standardize the baseline measurement values for each of the three-axes by calculating a mean and standard deviation for each of the three-axes and store the calculated mean and the standard deviation.

11. The authenticatable container tracking device of claim 10, wherein the processor is configured to standardize the detections by using the stored mean and the standard deviation for each of the three-axes and to transform the detections to a score matrix using the principle component analysis by using the loading matrix stored in memory.

12. The authenticatable container tracking device of claim 1, wherein the processor is further configured to periodically trigger the active mode for the three-axis magnetometer by causing the second level of power to be supplied from the power supply and receive the detections of the magnetic field signature from the three-axis magnetometer and after receiving the detections causing the first level of power to be supplied from the power supply to trigger the sleep mode.

13. The authenticatable container tracking device of claim 1, further comprising at least one environment sensor, the at least one environment sensor being selected from a group consisting of a light sensor, a temperature sensor, a humidity sensor and a pressure sensor, wherein the at least one environment sensor is in electrical communication with the processor.

14. The authenticatable container tracking device of claim 13, wherein the processor is configured to receive detections from the at least one environment sensor periodically, wherein the periodic detections from the at least one environment sensor are stored in memory and prior to generating the alert, the processor is configured to compare at least two successive detections from a same environment sensor to determine a change in an environmental condition and evaluate the detections from the three-axis magnetometer based on the determination of the change.

15. The authenticatable container tracking device of claim 14, wherein the processor eliminates a false positive alert based on the result of the comparison.

16. The authenticatable container tracking device of claim 1, further comprising a three-axis gyroscope, wherein the processor is configured to receive detections from the three-axis gyroscope periodically, wherein the periodic detections from the three-axis gyroscope are stored in memory and prior to generating the alert, the processor is configured to compare at least two successive detections from the gyroscope to determine a change in motion and evaluate the detections from the three-axis magnetometer based on the determination of the change.

17. The authenticatable container tracking device of claim 1, further comprising a transmitter, wherein when the alert is generated, the processor is configured to cause the transmitter to transmit a signal that is indicative of the alert to a monitoring station.

18. An authenticatable container tracking system comprising:

a non-metallic casing;

a plurality of magnets mounted to the non-metallic casing, the mounting allowing each of the plurality of magnets to conform to a ferrous surface portion of a target container, the mounting and the plurality of magnets being configured to securely attach the non-metallic casing to the ferrous surface portion of the target container, the non-metallic casing comprising:

a three-axis magnetometer having a sleep mode and an active mode, in sleep mode a first level of power is supplied to the three-axis magnetometer, in the active mode, a second level of power is supplied to the three-axis magnetometer, the three-axis magnetometer being configured to detect a magnetic field signature produced by a combination of the plurality of magnets and the ferrous surface portion of the target container and earth's magnetic field;

a shock sensor;

a transmitter;

a processor in electrical communication with the three-axis magnetometer, the shock sensor and the transmitter;

a memory; and a power supply configured to provide power to the processor, the shock sensor, the three-axis magnetometer and transmitter, the processor is configured to:

receive a detection indication from the shock sensor;

trigger the active mode for the three-axis magnetometer based on the detection indication by causing the second level of power to be supplied from the power supply;

receive detections of the magnetic field signature from the three-axis magnetometer over a measurement period; and cause the transmitter to transmit the received detections to an external processor, the external processor is configured to:

for each detection of the magnetic field signature, the external processor is configured to:

convert the detection to a value; and compare the value with an alarm threshold, determine a percentage of detections having the value above the alarm threshold; and compare the percentage of detections having the value above the alarm threshold with a preset percentage of allowed values above the alarm threshold, when the percentage of detections having the value above the alarm threshold is greater than the preset percentage of allowed values above the alarm threshold, the external processor is configured to generate an alert.

19. An authenticatable container tracking device comprising:

a non-metallic casing;

a plurality of magnets mounted to the non-metallic casing, the mounting allowing each of the plurality of magnets to conform to a ferrous surface portion of a target container, the mounting and the plurality of magnets being configured to securely attach the non-metallic casing to the ferrous surface portion of the target container, the non-metallic casing comprising:

a three-axis magnetometer having a sleep mode and an active mode, in sleep mode a first level of power is supplied to the three-axis magnetometer, in the active mode, a second level of power is supplied to the three-axis magnetometer, the three-axis magnetometer being configured to detect a magnetic field signature produced by a combination of the plurality of magnets and the ferrous surface portion of the target container and earth's magnetic field;

a processor in electrical communication with the three-axis;

a memory configured to store alarm threshold and a percentage of allowed values above the alarm threshold, the alarm threshold and the percentage being determined during a baseline measurement session; and a power supply configured to provide power to the processor and the three-axis magnetometer, the processor is configured to:

periodically trigger the active mode for the three-axis magnetometer by causing the second level of power to be supplied from the power supply for a detection session, the detection session having a measurement period;

receive detections of the magnetic field signature from the three-axis magnetometer over the measurement period;

after receiving the detection results, the processor is configured to cause the first level of power to be supplied from the power supply to trigger the sleep mode, for each detection of the magnetic field signature, the processor is configured to:

convert the detection to a value; and compare the value with the alarm threshold stored in the memory, determine a percentage of detections having the value above the alarm threshold; and compare the percentage of detections having the value above the alarm threshold with the percentage of allowed values above the alarm threshold stored in the memory, when the percentage of detections having the value above the alarm threshold is greater than the percentage allowed values above the alarm threshold, the processor is configured to generate an alert.

* * * * *